United States Patent [19]

Doughty

[11] 3,949,680

[45] Apr. 13, 1976

[54] VEHICLE TRACK AND VEHICLE

[76] Inventor: Howard E. Doughty, 529 Charlotte Ave., Fort Wayne, Ind. 46805

[22] Filed: Jan. 22, 1975

[21] Appl. No.: 543,146

[52] U.S. Cl. ..... 104/124; 104/69; 104/125; 104/242; 272/56.5 R

[51] Int. Cl.[2] ..... A63G 21/04; E01B 25/22

[58] Field of Search ..... 104/55, 56, 58, 59, 63, 104/69, 118, 119, 124, 125, 134, 242; 272/56.5 R, 1 R

[56] References Cited

UNITED STATES PATENTS

| | | | |
|---|---|---|---|
| 314,626 | 3/1885 | Stoddard et al. | 104/63 |
| 901,194 | 10/1908 | Sayer | 104/242 |
| 1,702,091 | 2/1929 | Sellner | 104/69 |
| 1,761,824 | 6/1930 | Goodrich | 104/118 |
| 1,805,266 | 5/1931 | Traver | 104/63 |
| 3,626,857 | 12/1971 | Goicoechea | 104/124 X |
| 3,631,805 | 1/1972 | Schwarzkopf | 104/63 |

*Primary Examiner*—John J. Love

*Assistant Examiner*—Andres Kashnikow

[57] ABSTRACT

A vehicle track and vehicle of the same general class of vehicles which includes toboggans, bobsleds, roller coasters, and other free-falling vehicles. The track includes a multiplicity of longitudinally joined, juxtaposed track sections and stanchions for supporting the section at selected elevations above the ground. Each section further includes a rigid supporting frame extending between adjacent stanchions and a pair of generally parallel, spaced-apart rails secured to the frame in a vertically spaced-apart relationship thereto. The frame and rails define therebetween an elongated channel. The vehicle includes an enclosure dimensioned to accomodate at least one person and to be received within the aforementioned channel. A plurality of wheels are rotatably mounted to the vehicle and in rolling engagement with the rails by means of axles secured to the vehicle at points above the bottom of the vehicle enclosure. Keeper means are secured to the vehicle for maintaining the wheels in engagement with the rails.

12 Claims, 12 Drawing Figures

VEHICLE TRACK AND VEHICLE

BACKGROUND OF THE INVENTION

1. Field of the Invention

The present invention relates to amusement rides and in particular to a vehicle ride which includes an elongated track comprised of a multiplicity of juxtaposed sections and a wheeled vehicle rollingly mounted on the tracks for free coasting movement thereon under the influence of gravity.

2. Description of the Prior Art

European bobsleding, while an exciting high speed sport that attracts broad interest, only a relatively few persons have actually participated in the sport. One reason for the limited participation in the sport is its seasonable characteristic. That is to say, the sport requires an elaborate course fabricated of snow and ice, and requiring a substantial amount of maintenance. The same can be said of the sport of tobogganing. Correspondingly, these sports have been limited to areas having long snow seasons.

The sport of bobsleding is further, by its nature, dangerous due to the high speeds of the bobsled and the relatively free movement of the bobsled while descending the course. Participation in the sport has therefore required substantial skill and a willingness to assume the risks thereof.

Attempts have been made to fabricate amusement rides that will simulate in some respects a bobsled course. Typical of these is the well known roller coaster. An example of the latter is disclosed in United States Pat. No. 1,702,091 to Sellner.

However, these prior art amusement rides have typically required elaborate custom built facilities. Each individual portion of the track or course is distinctly different from other portions of the course. The vehicles used for these facilities have been typically large, cumbersome, and expensive, or, as disclosed in the above referenced patent, are of a relatively lightweight character and of open construction exposing the riders. These facilities further bear little resemblance to a true bobsled course or bobsled whereby simulation of a bobsled course and a bobsled is more illusory than real.

There exists, therefore, a need for a simulated bobsled course and bobsled for use therewith wherein the course is fabricated from a multiplicity of substantially identical units. There further exists a need for such a course that closely simulates a real bobsled course and for such a course that is inherently safe. There also exists a need for such a course which can be used yeararound.

SUMMARY OF THE INVENTION

Broadly, the present invention is a simulated bobsled course and a bobsled. The bobsled course comprises an elongated track having a terminal end and a starting end elevated therefrom, the track including a multiplicity of longitudinally joined, juxtaposed track sections. Stanchion means are provided, there being one such means for supporting the sections at selected intervals above the ground. Each section includes a rigid supporting frame, a pair of generally parallel spaced-apart rails, and means securing the rails to said frame in a vertically spaced-apart relationship thereto. The frames, securing means, and rails, define therebetween an elongated channel.

The bobsled comprises broadly a vehicle including an enclosure dimensioned to accomodate at least one person and to be received within said channel. A plurality of wheels are rotatably mounted on the vehicle in rolling engagement with the rails, the axles of the wheels being secured to the enclosure at points above the center of gravity of the vehicle. Keeper means are provided for maintaining the vehicle in engagement with the rails at all times.

It is therefore an object of the invention to provide a simulated bobsled and bobsled course.

It is another object of the invention to provide a wheeled bobsled and course.

It is another object of the invention to provide a vehicle course fabricated from a multiplicity of similar track sections.

Still another object of the invention is to provide a vehicle course aesthetically compatable with a natural setting.

Still another object of the invention is to provide a simulated course and bobsled in which the bobsled is positively and safely maintained in engagement with the course under all conditions.

Another object of the invention is to provide a simulated bobsled and bobsled course that is durable and requiring minimum maintenance.

Another object of the invention is to provide a simulated bobsled and bobsled course that can be used year-around.

Another object of the invention is to provide a simulated bobsled and bobsled course which can be used in conjunction with other winter sport facilities.

Yet another object of the invention is to provide a vehicle course comprised of a multiplicity of similar track sections which can be selectively assembled to provide a simulated bobsled course of any desired configuration.

Still another object of the invention is to provide a vehicle and vehicle course in which the vehicle incorporates concealed wheels and closely resembles a conventional bobsled in appearance.

Another object of the invention is to provide a simulated bobsled and bobsled course which does not require skill or training in its use.

BRIEF DESCRIPTION OF THE DRAWINGS

The above-mentioned and other features and objects of this invention and the manner of attaining them will become more apparent and the invention itself will be best understood by reference to the following description of an embodiment of the invention taken in conjunction with the accompanying drawings, wherein.

DESCRIPTION OF THE SPECIFIC EMBODIMENT

Figure 1:
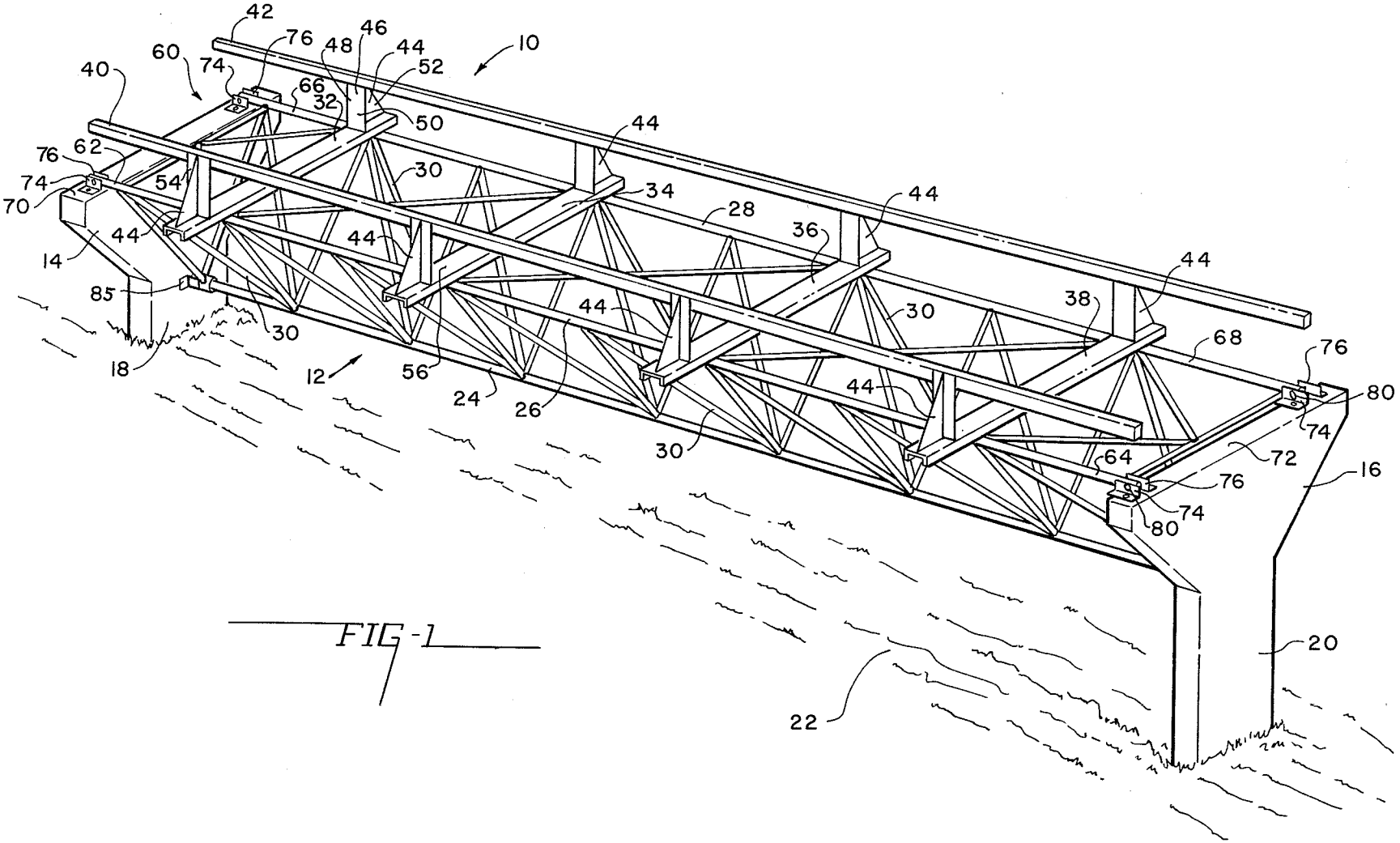
FIG. 1 is a fragmentary perspective view of a section of the bobsled course in accordance with the present invention.
Figure 3:
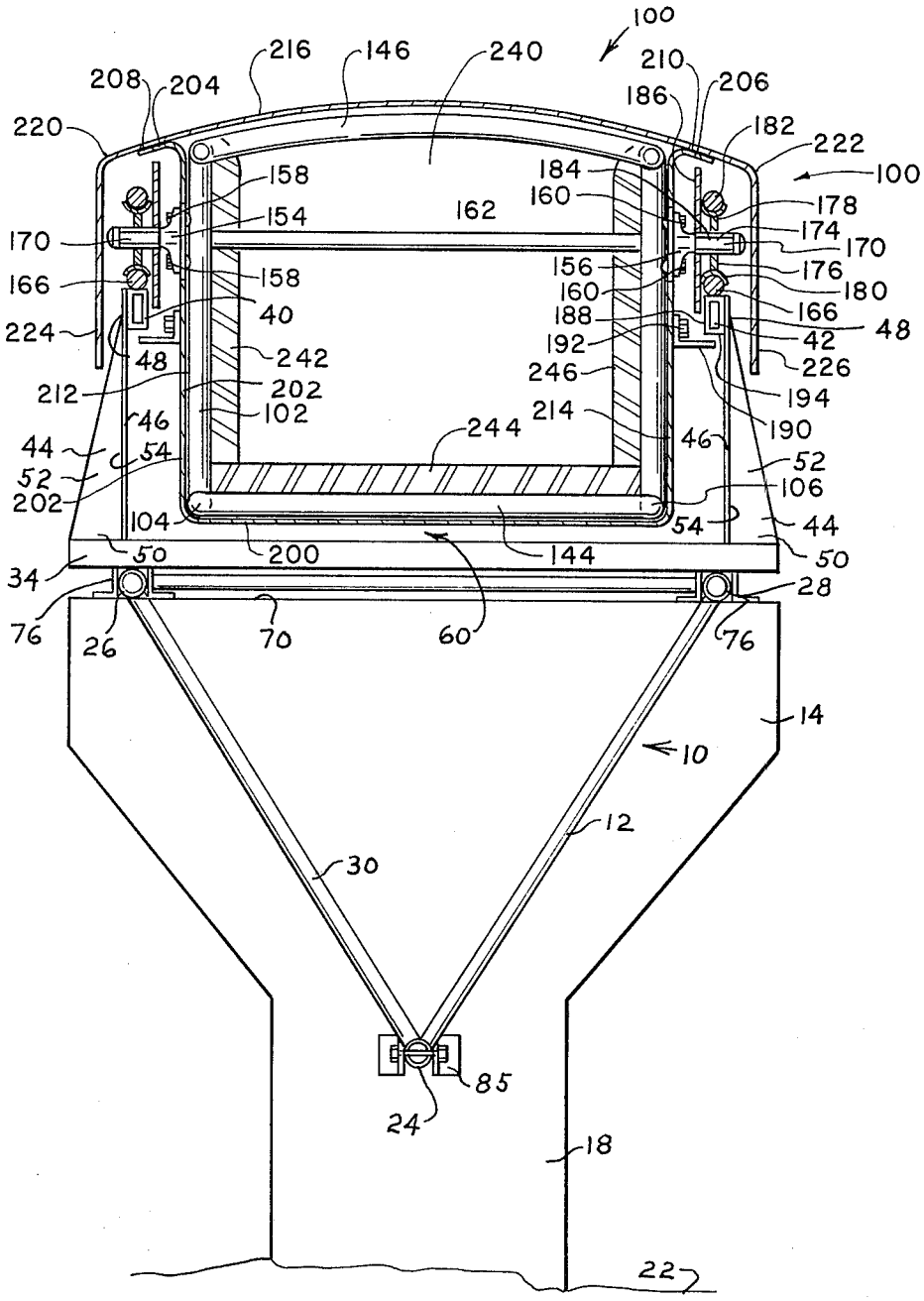
FIG. 3 is a sectional view of the bobsled taken generally along section line 3–3 of FIG. 2 and shown mounted on a track section.

Referring now to the drawings and in particular to FIGS. 1 and 3, there is illustrated a portion or section 10 of a bobsled course. Section 10 includes a rigid supporting frame 12 extending between and supported by a pair of spaced-apart support members or stanchions 14, 16. Stanchions 14, 16 are, in a specific embodiment, precast reinforced concrete pilings having a "Hammerhead" configuration. Stanchions 14, 16 have elongated base portions 18, 20, respectively, that are firmly received into the ground 22 thereby providing a strong and substantially immovable support for the bobsled course 10.

Frame 12 is, in a specific embodiment of the invention, an elongated space frame including a plurality of longitudinally extending frame members 24, 26, and 28. Members 24, 26, and 28 are fixedly joined together with a triangulated web of cross members at 30, members 24, 26, 28 and members 30 being joined as by welding. It will be observed that frame 12 has a generally triangular cross section with longitudinal members 24, 26 and 28 being disposed at the apices thereof. Members 24, 26, 28 and 30 may be made of rigid weather resistant material such as steel or aluminum.

A plurality of track supporting members 32, 34, 36 and 38 are fixedly secured to frame members 26, 28 as by welding, members 32, 34, 36, and 38 being disposed at longitudinally spaced-apart positions on members 26 and 28. Members 32, 34 and 36, and 38 may be formed of channel sections and also may be made of rigid weather resistant material such as steel or aluminum.

A pair of generally parallel, latterly spaced-apart rails 40, 42 are fixedly secured to members 32, 34, 36 and 38 in vertically spaced-apart relationship by means of suitable rail supports 44. Rails 40, 42 may be fabricated from tubular metal such as steel or aluminum having a rectangular cross-section.

Rail supports 44 include an elongated rectangular plate 46 which extends vertically between respective ones of members 32, 34, 36, and 38 and respective ones of rails 40, 42. Plates 46 are welded at their top and bottom ends 48, 50 to rails 40, 42 and members 32, 34, 36, and 38, respectively. Rail supports 44 further include a triangular plate 52 welded to the outwardly disposed surfaces 54 of plates 46 and the upperly disposed surfaces 56 of members 32 through 38 thereby providing rigid reinforcement thereto.

It will be observed that frame 12, members 32 thru 38, rails 40, 42, and track supports 44 are arranged such that they define a channel 60 therebetween.

Figure 7:
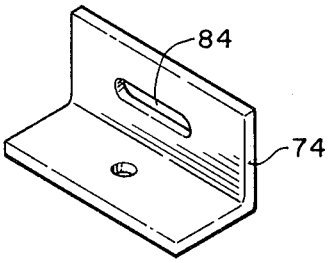
FIG. 7 is a perspective view showing details of means for securing a track section supporting frame to one of the stanchion means.

The opposite ends 62, 64 of members 26 and 66, 68 of member 28 overlie the top surfaces 70, 72 of stanchions 18, 20. A plurality of frame securing members 74, shown in FIG. 7, which may be made from short lengths of angle iron are fixedly secured to surfaces 70, 72 in oppositely facing pairs defining therebetween slots 76. Slots 76 are dimensioned to receive therebetween ends 62, 64, 66 and 68, respectively. Members 74 are fixedly secured to surfaces 70, 72 by means such as bolts (not shown) which may be cast into the stanchions 18, 20 when the latter are formed. End portions 62, 64, 66, and 68 are secured in slots 76 by means of suitable pins 80 (FIG. 1 only) which are received through suitable holes in the ends 62, 64, 66, and 68, (not shown) and holes 84 in the members 74. Preferably, holes 84 are elongated as best seen in FIG. 7 to allow for expansion and contraction of the frames 12 due to changes of temperature. In a similar manner, member 24 is secured to stanchions 14, 16 by means of securing angles as at 85, the latter being secured to stanchions 14 and 16 by means of suitable bolts or the like (not shown) integrally molded into the stanchions 14, and 16 as they are formed. (See FIGS. 1 and 3) Members 74 and plates 46 and 52 may be of rigid, weather resistant material such as steel or aluminum.

Figure 9:
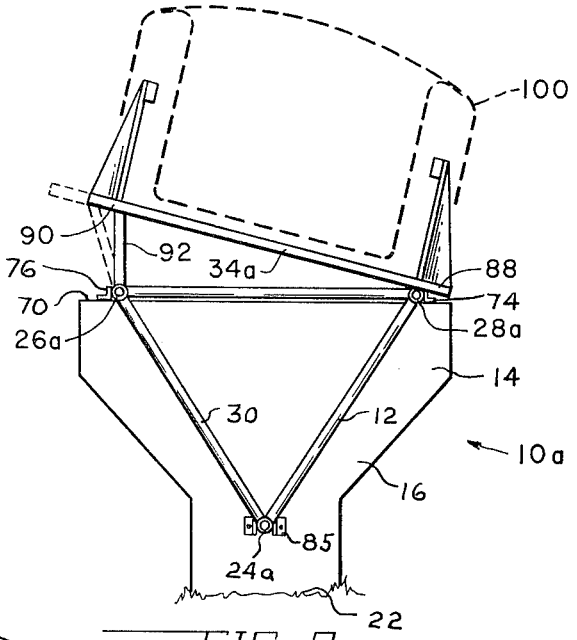
FIG. 9 is an end sectional view showing details of a curved track section.
Figure 4A:
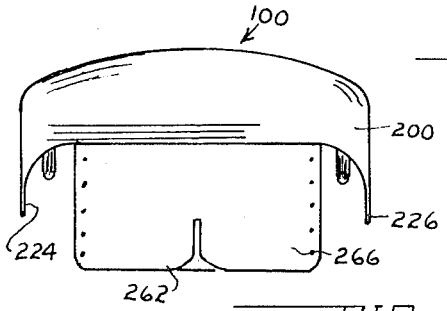
FIG. 4*a* is a front plan view of the bobsled illustrated in FIGS. 2, 3 and 4.
Figure 10:
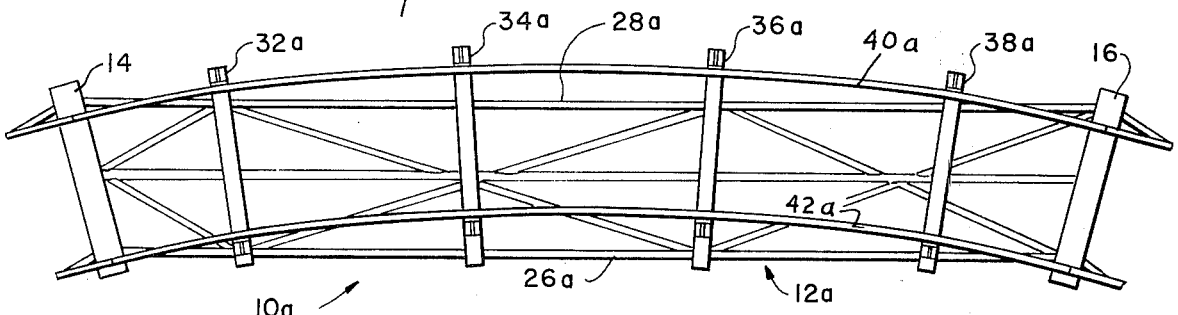
FIG. 10 is a top plan view of a curved track section.

Referring now particularly to FIGS. 9 and 10, there is shown a curved section 10*a* of the bobsled course. Course section 10*a* is similar to a straight section 10 and includes a pair of longitudinally spaced-apart stanchions 14, and 16, supporting frame 12*a* extending therebetween. Supporting frame 12*a* is an elongated space frame structure wherein the lengths of the frame members 26*a*, 28*a* are different lengths whereby they may be properly joined to the stanchions 14, 16, the latter being disposed at an angle with respect thereto. The angled positions of the stanchions 14, 16 in turn are required to accomodate joining thereof to the longitudinally adjacent track or course sections 10 (not shown in FIG. 10). It will be apparent to those skilled in the art, that the longitudinal members 26, 28 of the straight sections 10 will have to be altered at a juncture thereof with a curved section 10*a* in view of the angled position of the stanchions 14, 16 of the curved section 10*a*.

Curved sections 10*a* further have the members 32*a*, 34*a*, 36*a*, and 38*a* disposed at an angle with respect to the plane including members 26*a*, 28*a* to thereby provide banking of the curve. This is effected by securing one and 88 of the members 32*a*, 34*a*, 36*a*, and 38*a* directly to the longitudinal member 28*a* and supporting the opposite end 90 of the members 32*a*, 34*a*, 36*a*, and 38*a* above longitudinal member 26*a* by means of a support member 92. Members 32*a*, 34*a*, 36*a*, and 38*a* may also be longer than members 32, 34, 36, and 38 of a straight section to accomodate the curvature of the rails 40*a*, 42*a* as best seen in FIG. 9. This permits the supporting frames 10*a* to be substantially identical to supporting frames 10, thereby increasing the standardization of the components of the course. It will be observed that the length of the support members 92 can be varied as desired providing different degrees of banking for the track sections 10*a* and the length of the members 92 can be increased or decreased in gradual increments to provide for matching the curved sections 10*a* with the straight sections 10. In the alternative, straight sections 10 can be provided with support members 92 thereby permitting the bank angle to be reduced in a straight section 10 rather than adjacent the end of a curved section 10*a*.

Figure 6:
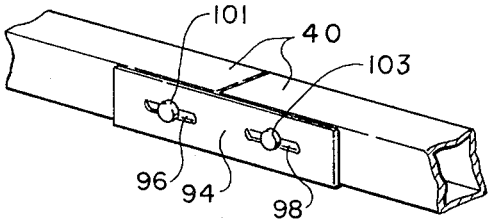
FIG. 6 is a fragmentary perspective view showing details of an expansion joint for use in securing together track sections of the present invention.

As can be seen in FIG. 6, adjacent ends of rails 40 and 42 are preferably joined by rectangular plates 94, plates 94 being provided with elongated slots 96, 98. Suitable fasteners 101, 103 are received thru the slots 96, 98, fasteners 101 and 103 having enlarged heads as at 104. The small gaps in the rails 40 or 42 between adjacent section 10 resulting from expansions and contraction of the course will not deleteriously affect the movement of the bobsled wheels thereover.

Figure 2:
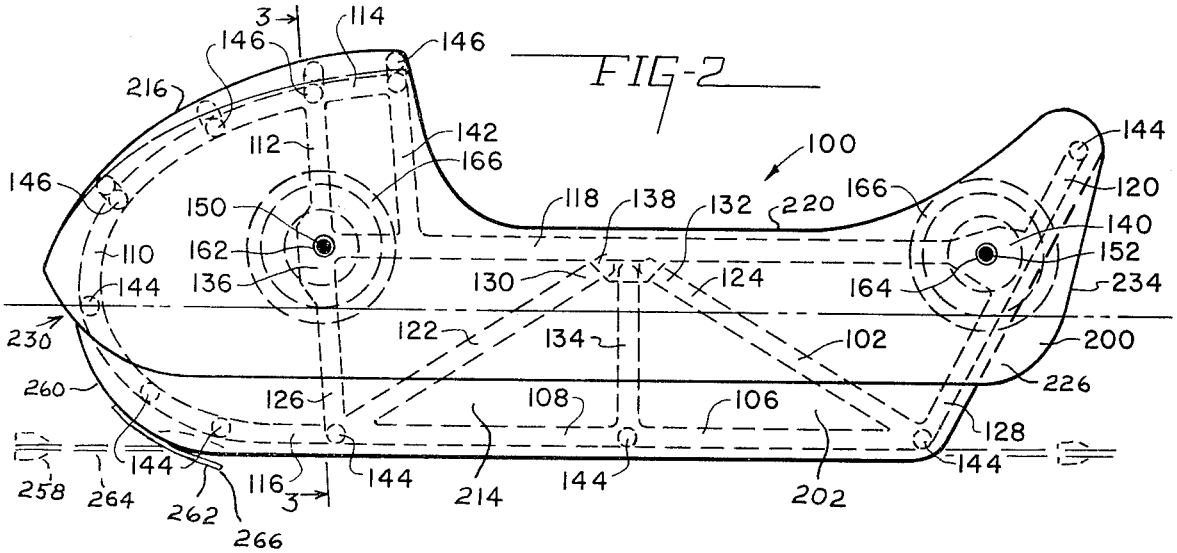
FIG. 2 is a side plan view of a bobsled in accordance with the present invention.

Referring to FIGS. 2 and 3, there is illustrated a bobsled 100 used with the bobsled course 10. Bobsled 100 comprises a supporting frame 102 fabricated substantially from tubular elements. Frame 102 includes a pair of laterally spaced-apart side frames 104, 106. Frames 104 and 106 are substantially identical, therefore a description of one will suffice for both. Side frame 106 includes a side member 108 having a curved front portion 110 which may be formed by bending. A vertical front brace 112 extends between distal portions 114, 116 of curved portion 110. A side rail 118 extends horizontally between member 112 and a rear transom member 120, the latter being angled rearwardly as best seen in FIG. 2.

Braces 122, 124 extend at angles between the lower ends 126, 128 of members 112 and 120, to a point adjacent the center of rail 118. A vertical brace 134 extends between the juncture of ends 130, 132 of members 122 and 124, and member 106. Preferably, reinforcing plates 136, 138, and 140 are provided at the junctures of members 112 and 118; 122 and 124; 108, and 120, respectively. A vertical reinforcement member 142 is provided between side rail 118 and end portion 114 of member 108.

Side frames 104, and 106 are joined by a plurality of laterally extending lower brace members 144, and arched upper brace members 146. The individual members of the frame 102 are joined preferably by welding. Openings 150, and 152 (FIG. 2 only) are formed thru reinforcing plates 136 and 140, and axle mounting flanges such as flanges 154, and 156 (FIG. 3 only) are secured thereto by means of threaded fasteners 158 and 160. Axles 162, and 164 are received through the flanges 154 and 156 and secured by means (not shown) such as shoulders formed on axles 162, 164, set screws, or the like.

A plurality of wheels 166 are individually, rotatably mounted to the ends 170 (FIG. 3 only) of axles 162 and 164. All of the wheels 166 are identical and therefore a description of one will suffice for all. Wheel 166 includes a hub 174 having internally mounted, high speed, ball or roller bearings (not shown) whereby the wheel 166 will rotate freely with minimum friction on the axles 162, and 164. Wheel 166 further includes a flange or web portion 176 extending radially outwardly from the hub portion 174. The circumferential edge 178 of flange 176 has formed thereon an arcuately recessed rim 180. A rubber or a rubber-like tire 182 is received on the rim 180 and rollingly engages the track 42. Secured to the inboard end 184 of hub 174 is a large disc or flange 186. As best seen in FIG. 3, disc 186 has a diameter larger than an outside diameter of the tire 182 whereby it overlies the inside surface 188 of track 42. Disc 186 slideably engages the inside surface 188 of track 42, and, in one specific embodiment of the invention, disc 186 may be coated with lubricant such as teflon to reduce the frictional contact thereof with the track 42. Disc 186 functions to retain the wheels 166 in proper engagement with the rails 40, 42.

Suitable keepers 190, which may comprise rigid pieces of angle, are fixedly secured to the frame 102 with suitable threaded fasteners 192. Keepers 190 are positioned to underlie the bottom surface 194 of track 42 thereby positively preventing disengagement of the bobsled 100 from the tracks 42 and 44.

Figure 5:
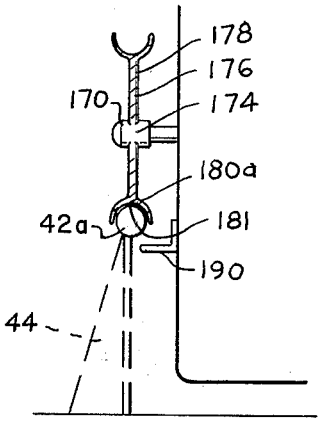
FIG. 5 is a fragmentary plan view showing details of an alternative embodiment of the wheels of a bobsled of the present invention.

In an alternative embodiment of the invention, shown in FIG. 5 the tracks **42*a*, and 44*a* are tubular members of circular cross-section. In this embodiment, the tire 182 is provided with a recessed rim 180*a* which engages the rail 42*a* in a manner such that the rim 180*a* retains the bobsled from lateral movement on the tracks. The arcuate surface 181 of rim 180*a*** may be rubber coated.

Frame 102 is enclosed within a suitable body 200. Body 200 includes an inner shell 202 which is received over frame 102 and is secured by suitable threaded fasteners (not shown). The upper edges 204, 206 of inner shell 202 have outwardly turned flanges 208, 210, (FIG. 3 only) the sides 212, 214 of inner shell 202 being disposed inwardly of the wheels 166. Top shell 216 overlies frame members 146 and is secured to the inner shell 202 by bonding to the flanges 208 and 210. The sides 220, 222 of shell 216 extend outwardly over the wheels 166 and are provided with downwardly depending skirts 224, and 226, respectively. Skirts 224, 226 totally enclose wheels 166 such that persons in the bobsled 100 cannot be injured or otherwise accidentally get their hands engaged with the wheels 166.

Figure 4:
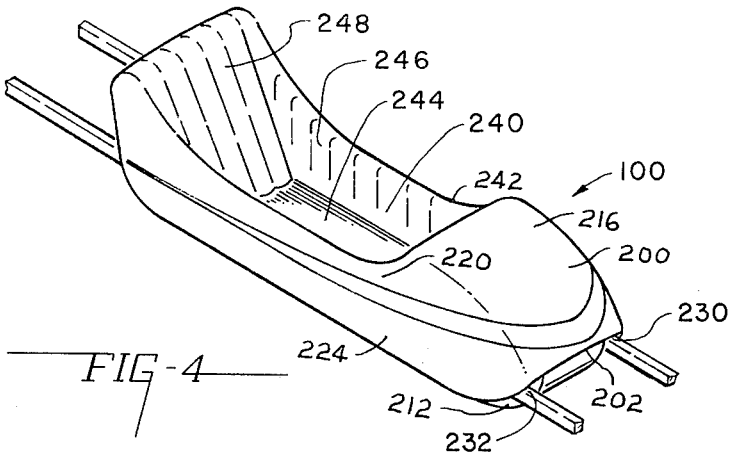
FIG. 4 is a perspective view of the bobsled on a fragmentary track section.

There will further be observed that the skirts 224, 226 are open at their front ends 230, 232 whereby the rails 40, 42, are received therethrough between the skirts 224, 226 and the inner shell 202. It will be further observed that the skirts 224, 226 conceal the wheels of vehicle 100 thereby enhancing the illusion or simulation thereof of a genuine bobsled. Preferably, inner shell 202 and top shell 216 are contoured as best seen in FIGS. 2 and 4 for aesthetic purposes and to further simulate the appearance of a true bobsled. The interior 240 of the bobsled 100 is preferably deeply padded with suitable cushions 242, 244, 246 and 248 to increase the comfort thereof and to further protect the passengers.

Figure 11:
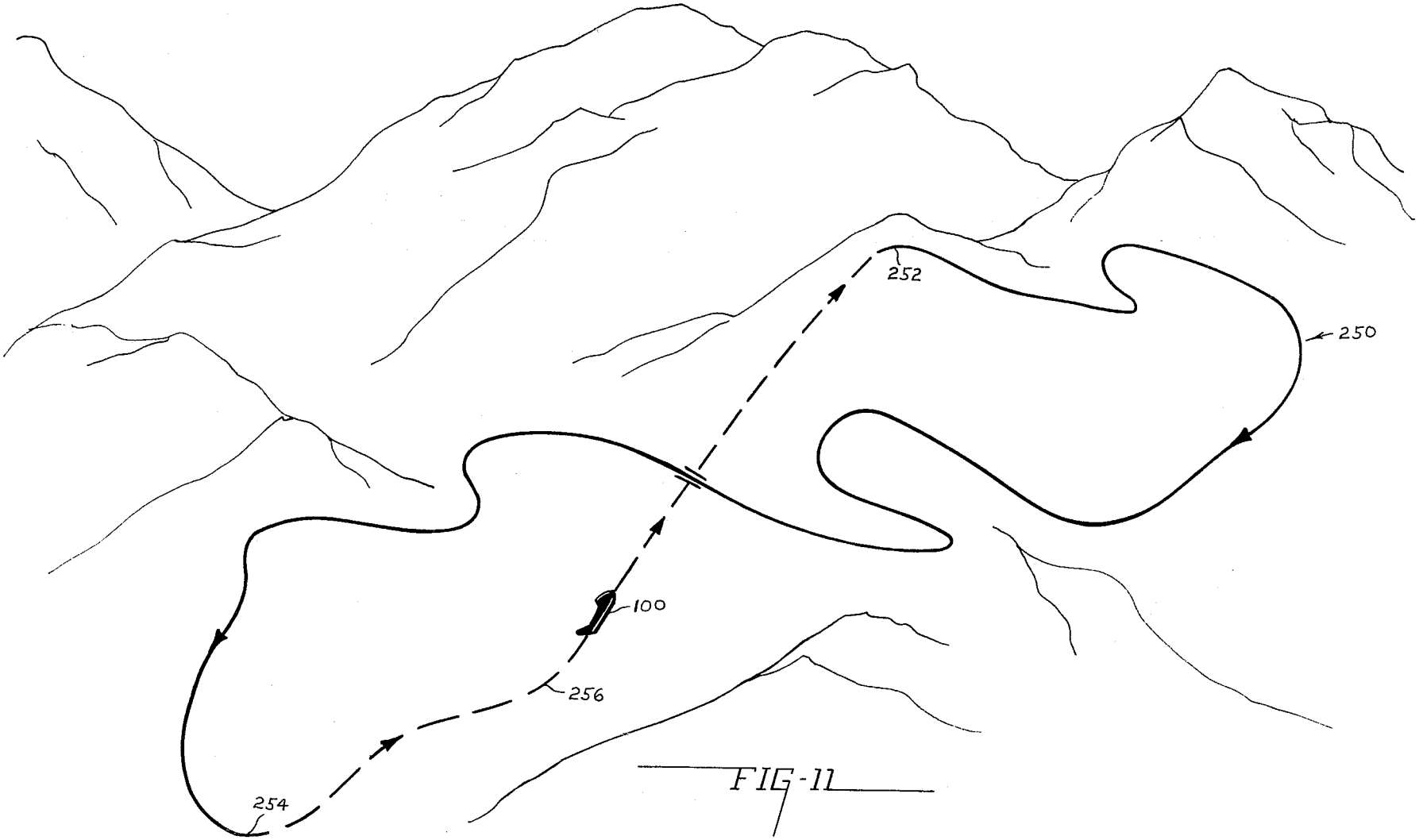
FIG. 11 is a perspective view showing a typical installation of the present invention.

Referring now to FIG. 11, there is illustrated a typical installation of a bobsled in accordance with the present invention. The bobsled course 250 comprises a plurality of sections 10 continuously joined to form a circuitous route over any suitably hilly terrain. The course has an upper end 252 and a lower end 254 the former being substantially elevated from the latter. The course can be continuously downwardly sloped or may undulate as desired it only being necessary that the upwardly sloped portions of the course do not cause the bobsled 100 to come to a stop at any point during its descent. Interposed between upper and lower ends 252, 254 is a suitable lift 256 which may be of any conventional configuration.

Typically, the lift portion 256 of the course (shown in dashed lines) will include a plurality of track sections such as section 10 as above described. In addition, suitable towing means such as an elongated, winch-driven cable is associated with the lift portion of the course 256, the cable and the bobsled 100 being provided with suitable engaging means whereby the bobsled 100 is coupled to the cable and drawn upwardly to the starting point at end 252 of the course 250. For example, in a specific embodiment an elongated and continuous cable is mounted adjacent the bottom of the channel 60 defined by the tracks and track structure. The cable is provided with a plurality of steel balls 258 (FIG. 2 only) secured to the cable at various points along the cable, the distance between balls being greater than the overall length of the bobsled. Affixed to the forward end 260 of the bobsled is a sheet metal panel 262 so positioned that it overrides the elements 258 when the bobsled moves into the lift portion of the course 250. Plate 262 will "ratchet" over the elements 258 until the speed of the bobsled is about equal to the speed of the cable 264. At this time, the elements 258 will engage the plate 262 and the bobsled 100 will be drawn to end 252 of the course.

Figure 8:
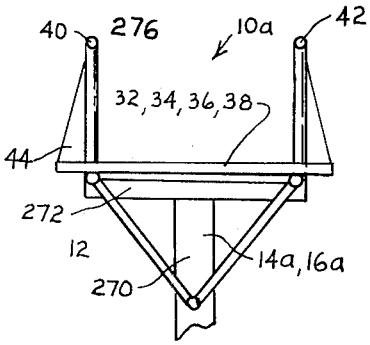
FIG. 8 is an end sectional view of an alternative embodiment of a track section.

Referring now to FIG. 8, there is shown an alternative embodiment of a track section 10*b*. This track section includes rigid supporting frame 12 and stanchions 14*a*, 16*a* rather than stanchions 14, 16. Stanchions 14*a*, 16*a* each include a post 270 and a cross-member 272. Track supporting members 32, 34, 36, and 38, and rails 40, 42 are secured to frame 12 as above described. The post and cross-members of stanchions 14*a*, 16*a* may be concrete as are stanchions 14, 16, or in the alternative, wood, metals such as steel or aluminum, or the like. Further, post 270 and cross-member 272 may be conventional structural members such as channels, I-beam and the like.

From the above description it will be seen that the bobsled course and the bobsled of the present invention effects an amusement ride which closely simulates a true bobsled and bobsled course. The entire course if fabricated from a multiplicity of substantially identical track sections which can be mass produced at a suitable manufacturing facility. The course can be easily installed over any suitable terrain and does not deleteriously interfere with the natural setting and other aesthetics of the area. The bobsled positively engages the course since it cannot become accidentally disengaged therefrom whereby the bobsled and bobsled course are inherently safe. The entire structure is rugged and requires minimum maintenance and can be utilized during different seasons. Because of the elevation of the course above the ground, use thereof during snow seasons is not hampered. Similarly, during summer months when there is no snow upon the ground, the course, because it does not rely upon snow, ice or freezing conditions can still be utilized thereby enhancing the economics thereof. The bobsled course can be used in conjunction with other winter sport facilities such as ski slopes and the like. While the entire course is fabricated from substantially identical track sections, the overall layout of each individual course can be varied as desired. The bobsled itself, because of the concealed wheels and general construction thereof, closely resembles a true bobsled. This structure also effects a bobsled like vehicle that is inherently safe. The bobsled and bobsled course provide a ride which is exciting and yet does not entail any danger and does not require special skills for training in its use.

While there have been described above the principles of this invention in connection with specific apparatus, it is to be clearly understood that this description is made only by way of example and not as a limitation to the scope of the invention.

What is claimed is:

1. A vehicle and vehicle track, the combination comprising an elongated track having a terminal end and a starting end elevated therefrom, a rigid supporting frame selectively elevating said track above the ground, said frame including a plurality of stanchion member means and a plurality of space frames each including a plurality of fixedly joined frame members, each of said space frames extending between adjacent stanchion member means, a pair of generally parallel, spaced-apart rails, means securing said rails to said space frame in a vertically spaced-apart relationship thereto, said space frame and rails defining therebetween an alongated channel, a vehicle including an enclosure dimensioned to accomodate at least one person, said enclosure having a bottom, said vehicle being received in said channel, a plurality of wheels rotatably mounted to said vehicle and being in rolling engagement with said rails, the axles of said wheels being secured to said vehicle at points above the bottom of said vehicle enclosure, and keeper means coupled to said vehicle for maintaining same in engagement with said rails.

2. The combination of claim 1 wherein said track includes a multiplicity of longitudinally joined and juxtaposed track sections.

3. The combination of claim 1 wherein said space frames include a frame section which is triangular in cross-section, there being an elongated member extending longitudinally of said frame section at the apices of said triangular cross-section and a plurality of braces secured in triangular array between said elongated members.

4. The combination of claim 1 wherein said stanchion means comprise pilings having one end thereof adapted to be fixedly secured in the earth, said pilings each having an upper end, there being means fixedly secured to such stanchion means adjacent the said upper ends thereof for securing said supporting frame thereto.

5. The combination of claim 4 wherein said supporting frame includes elongated members which extend longitudinally of said track, said securing means includes a plurality of brackets fixedly secured to said upper ends of said stanchion means, the distal ends of said elongated members being secured to predetermined ones of said brackets.

6. The combination of claim 5 wherein said brackets and said elongated members are joined with a slip joint to accomodate contraction and expansion of said track sections.

7. The combination of claim 2 further including slip joint means for joining contiguous ones of said track sections together.

8. The combination of claim 1 wherein each of said wheels further includes an enlarged disc fixedly secured thereto and axially inwardly thereof, said disc having an outside diameter larger than the outside diameter of said wheels, said disc being disposed generally parallel to radii of said wheels and overlying the inside surface of said rails thereby to maintain said wheels in alignment with said rails.

9. The combination of claim 4 wherein said wheels each include a concavely recessed peripheral surface generally complimentary to the cross-section of said rails, said recessed outer surface maintaining said wheels in alignment with said rails.

10. The combination of claim 1 wherein said vehicle further includes a pair of skirt portions fixedly secured thereto, said skirt portions extending outwardly and downwardly of said enclosure and defining therebetween a pair of recesses extending longitudinally with respect to the center line of said vehicle, said wheels being disposed within said recesses whereby said wheels are concealed.

11. The combination of claim 10 wherein said vehicle further includes a supporting frame, said enclosure and said skirt portions enclosing said frame, a pair of axles extending laterally of said vehicle adjacent to forward and rear ends thereof, respectively, said wheels being rotatably mounted to said axles, said axles being secured to said frame at points thereon above the center of gravity of said vehicle.

12. The combination of claim 11 wherein said keeper means comprise a plurality of members fixedly secured to said frame, each said member including an outwardly extending flange portion, said flange portions being positioned to underly the bottom surface of said rails.

* * * * *